United States Patent [19]

Sparfel

[11] Patent Number: 4,923,329

[45] Date of Patent: May 8, 1990

[54] DRAINING METHOD AND A MACHINE FOR IMPLEMENTING SAME

[76] Inventor: Jean-Claude Sparfel, Route de Plouider, 29260 Lesneven, France

[21] Appl. No.: 301,062

[22] Filed: Jan. 25, 1989

[30] Foreign Application Priority Data

Dec. 28, 1988 [FR] France ..... 88 17553

[51] Int. Cl.[5] ..... E02B 11/02; F16L 1/02

[52] U.S. Cl. ..... 405/36; 405/50; 405/179

[58] Field of Search ..... 405/36, 50, 51, 258, 405/174, 179, 180

[56] References Cited

U.S. PATENT DOCUMENTS

| | | | |
|---|---|---|---|
| 2,850,843 | 9/1958 | Marbury | 405/36 X |
| 3,336,755 | 8/1967 | Renfro | 405/50 |
| 3,438,206 | 4/1969 | Stark | 405/50 |
| 4,028,902 | 6/1977 | Courson et al. | 405/179 |
| 4,116,014 | 9/1978 | Satterwhite | 405/179 |

FOREIGN PATENT DOCUMENTS

| | | | |
|---|---|---|---|
| 0085606 | 8/1983 | European Pat. Off. | 405/50 |
| 2422772 | 12/1979 | France | 405/50 |
| 895297 | 1/1982 | U.S.S.R. | 405/50 |

*Primary Examiner*—David H. Corbin

*Attorney, Agent, or Firm*—Oblon, Spivak, McClelland, Maier & Neustadt

[57] ABSTRACT

A drainage method is provided for the construction or renovation of stabilized or grass-covered grounds, particularly sports grounds, and a machine for implementing same. It consists in forming a network of first and second surface drainage trenches which intersect each other, the second trenches being oriented in the direction of the slope and appreciably deeper than the first trenches so as to be provided with drains which are situated below the level of the bottom of the first trenches, the drains communicating with a collector at the side of the ground and the assembly of trenches being filled with filtering material.

19 Claims, 3 Drawing Sheets

DRAINING METHOD AND A MACHINE FOR IMPLEMENTING SAME

BACKGROUND OF THE INVENTION

1. Field of the Invention

The present invention relates to a draining method used in the construction or renovation of stabilized ground, grass-covered ground such as public parks, green parking lots and particularly sports grounds (football, rugby, hockey, golf, horse-riding tracks, etc.). It also relates to a machine for implementing this method.

Sports grounds are subjected to particular requirements which make their construction very delicate. In the first place, they must withstand intensive and repeated trampling which leads to packing of the earth on the surface and tearing up of the grass. Furthermore, because the maximum use of such grounds takes place in the winter months when bad weather is at its worst, there is a need to provide very good drainage of the water from the surface layer of the ground, so as to prevent the formation of surface mud and an irreversible deterioration phenomenon. However, percolation of water through the soil must be perfectly controlled so that in fine weather the earth retains sufficient humidity for re-growth of the grass. Another important factor to be taken into consideration for the construction of such grounds is their cost price.

2. Description of the Related Art

A conventional technique of constructing sports grounds consists in forming a platform free of topsoil and levelled of the banked up beds between which drains are placed in a herring-bone pattern, forming a layer of pebbles or gravel and covering it with previously improved topsoil. So as to obtain perfect percolation through the ground, it is necessary to add a large amount of river sand to the topsoil, generally in a proportion between 50 and 70%. The large amounts of sand and gravel or pebbles used consequently represent considerable costs and work for laying them. Furthermore, the ground formed using this technique does not give entire satisfaction: in the case of repeated rain, it is difficult to avoid stagnation of the water on the ground so that it becomes practically unusable; and in summer, the presence of the layer of pebbles or gravel results in mediocre water retention of the topsoil, little favorable to a good grass quality: in particular, the rooting depth is not very great.

In a more recent technique, surface drainage trenches are formed in the ground communicating with base trenches equipped with drains. The method is put into practice in the following way: first of all, the layer of topsoil is removed to a depth of about 20 cm: after which the platform is levelled while respecting particular slope conditions natural slope of the ground, transverse slope, longitudinal slope or roof-shaped slope. In practice, the slope is between 1 and 1.5%. Then the base drainage trenches are formed, drains being laid at the bottom thereof and then the trenches are filled with gravel or another filtering material. These trenches are aligned in the direction of the slope, chosen the most often in the transverse direction of the ground. On the side of the ground, the drains communicate with a collector opening into any type of outlet: river, pond, communal network, etc.

The topsoil is then replaced and levelled. The stones are then cleared away mechanically, the soil is decompacted, then the topsoil is improved by spreading basic fertilizers and incorporating sand to a depth of about 10 cm mixing taking place on the site. After checking the inherent flatness, the surface drainage trenches are formed perpendicularly to the base trenches and filled with gravel. They are sufficiently deep for intersecting the base trenches over a height of a few centimeters. Two parameters influence the quality of communication between the surface trenches and the base trenches at their intersection point: on the one hand, the intersection over a height of a few centimeters of the base trench by the surface trench and, on the other hand, the width of the base trench which is chosen very large, generally about 20 cm.

Once the drainage system has been constructed, the whole ground is covered with sand to a thickness of about 2 cm, the flatness is corrected using a beam after which the grass may be sown and rolled.

Different techniques are used for providing surface drainage, one of which consists in forming trenches of a width of about 7 cm with an excavating wheel machine and an earth recovery device, described and claimed in the French Patent Application 2 546 203 in the name of the present Applicant.

In grounds constructed using the above described technique, drainage is no longer based on percolation through the soil, but on the streaming of water towards the surface drainage trenches, promoted by the slope of the ground. The topsoil therefore does not require a great deal of physical improvement, and the amount of river sand used is reduced, as well as that of gravel or filtering material. On the other hand, the retention of humidity by the topsoil is satisfactory in summer, as well as the rooting depth of the grass obtained.

SUMMARY OF THE INVENTION

An object of the invention is to improve this technique by a method of drainage much simpler to put into practice and of increased efficiency.

Another object of the invention consists in providing such a drainage method which can be used for the renovation of existing grounds.

Another obJect of the invention consists in providing a machine specially adapted for implementing said drainage method.

According to the invention, the drainage method consists in forming over the whole surface of a ground a network formed of first surface drainage trenches and second surface drainage trenches crossing the first trenches, the second trenches being oriented in the direction of the slope of the ground and being appreciably deeper than the first trenches, so as to be provided in their bottom with drains which are below the level of the bottom of the first trenches, the drains communicating with a collector at the side of the ground, and the assembly of trenches being filled with filtering material.

BRIEF DESCRIPTION OF THE DRAWINGS

The invention will be better understood from the following explanations and accompanying drawings, in which.

DESCRIPTION OF THE PREFERRED EMBODIMENTS

Figure 1:
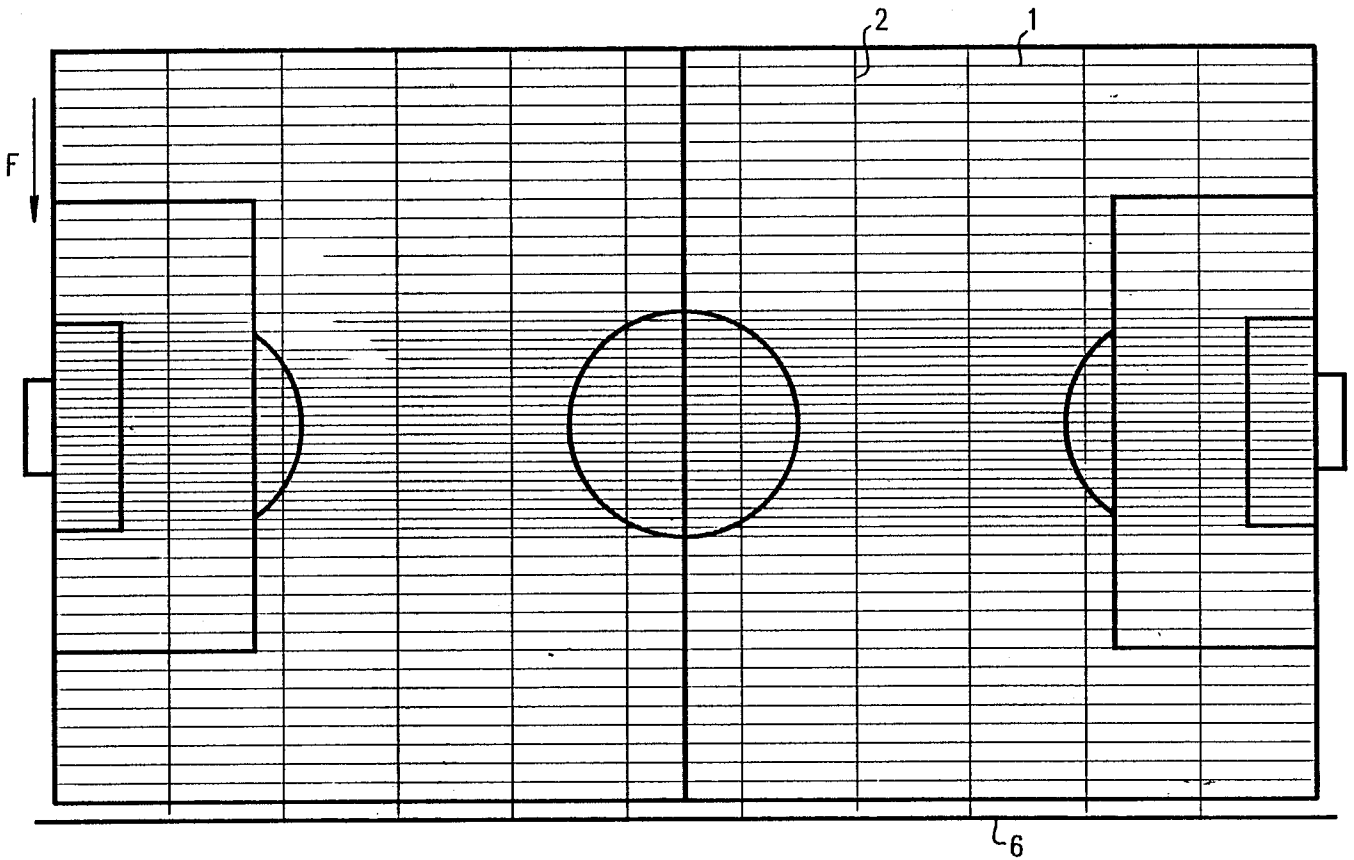
FIG. 1 is a top view illustrating a network of drainage trenches in accordance with the invention in a sports ground.

The ground illustrated in FIG. 1 is a football ground. The arrow F at the side indicates a transverse slope.

The thin longitudinal and transverse lines represent a network of longitudinal surface drainage trenches 1 and transverse surface drainage trenches 2.

Figure 2:
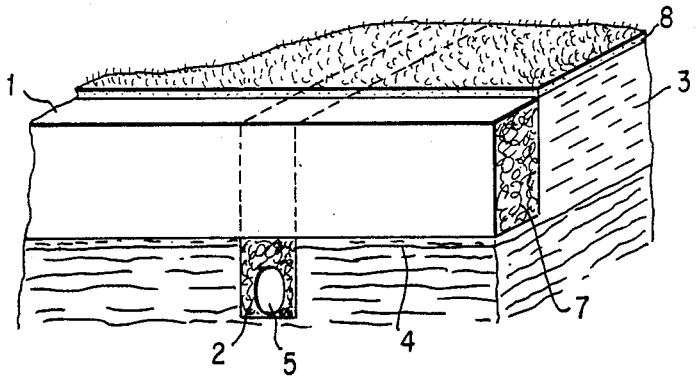
FIG. 2 is a schematic view of the sub-soil at the crossing point of two drainage trenches.

The longitudinal trenches 1 have a depth which corresponds substantially to that of the topsoil 3, as shown in FIG. 2. They have a width of about 7 cm and their spacing apart varies between about 0.60m and 1.20m, depending on the zone of the ground. In FIG. 1, the trenches are spaced closer together at the centre, where trampling is greatest, and further away in the wings.

The transverse trenches 2 have the same width as trenches 1, but they have an appreciably greater depth, generally between 30 and 40 cm, so that their bottom is below the level of platform 4. As shown in FIG. 2, on the bottom of trenches 2 drains 5 are laid which communicate with a collector 6 (FIG. 1) at the side of the ground. Trenches 2 are spaced evenly apart by a distance which is generally between about 6 and 10 m. Of course, the trenches 2 comprising drains 5 are always oriented as a function of the slope of the ground. If this slope is longitudinal, the network will therefore be reversed with respect to that of FIG. 1, Trenches 1 and 2 are filled with filtering material 7, generally gravel, up to the upper level of the topsoil. The whole ground, trenches included, is then covered preferably with a layer of sand, whose thickness is generally between about 2 and 8 cm. With the sand forming this layer may be associated mixed synthetic or plant fibers, so as to form an homogeneous mixture. Such a surface layer gives flexibility to the ground and, in the case of grassed grown ground, it substantially improves the anchorage of the roots in the soil and, consequently, resistance of the grass to being torn up.

The principle of the operation of the drainage network obtained by the method of the invention is the same as that of the network formed by surface drainage trenches and base trenches described above. However, it has important advantages in that the trenches 2 provide both the function of surface drainage trench and that of base trench and in that the intersections between trenches 1 and trenches 2 take place over the whole height of trenches 1, thus providing perfect communication therebetween. It should be further noted that much less gravel is required for filling trenches 2 than the base trenches mentioned above because of the appreciably greater width of the latter.

In addition, the drainage method of the invention is much easier to put into practice. In the previous technique, the formation of the base trenches and laying of the drains take place Just after levelling of the platform, i.e. before the replacement, improVement and levelling of the topsoil, so that, for these operations, care must be taken not to damage the trenches and not to crush the drains. In practice, these necessary precautions generally preclude the use of heavy equipment, which is a handicap. The drainage method of the invention brings a solution to this problem in that all the trenches are formed once the main work concerning the replacement, improvement and levelling of the top soil has been finished.

Furthermore, when it is a question of renovation, the drainage method of the invention may be used without requiring repairing of the whole surface of the ground: trenches 1 and 2 are formed with recovery of the earth, the drains for trenches 2 are laid and filled with filtering material 7. They are covered with sand and are then sown with grass. The period during which the ground resulting from such work is out of use is not very long; it generally does not exceed the between season period.

Figure 4:
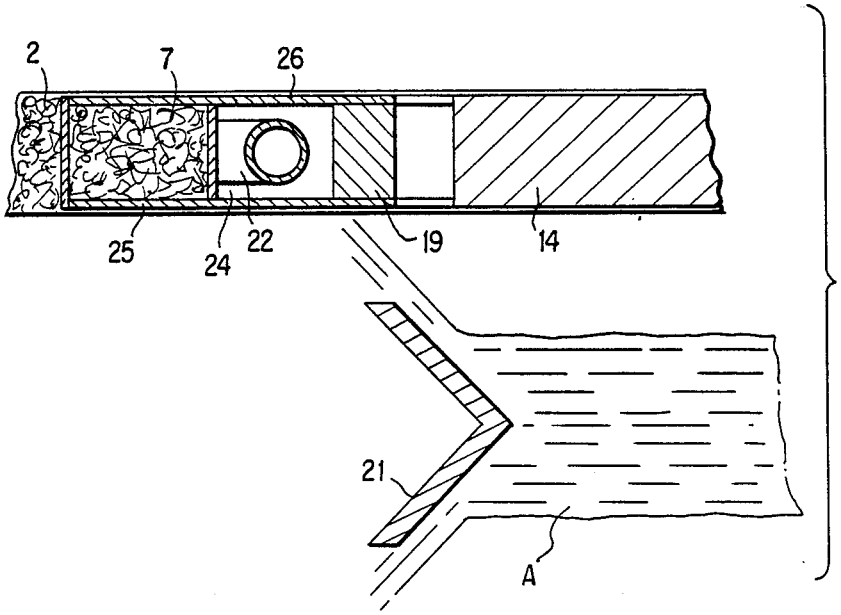
FIG. 4 a partial schematic view in section through line IV—IV of FIG. 3.
Figure 3:
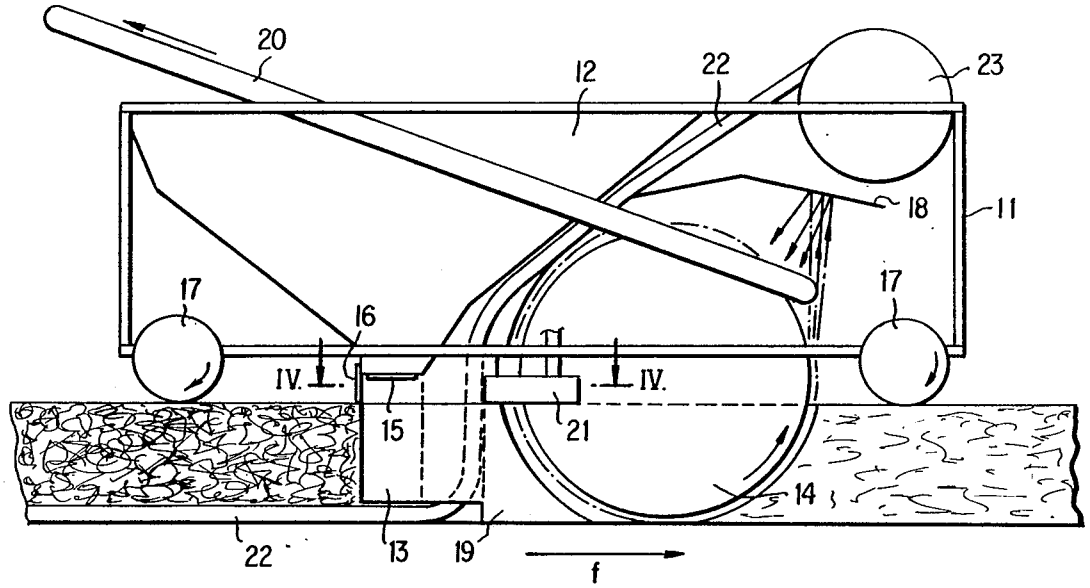
FIG. 3 is a schematic view of a machine of the invention and the operation thereof.

The machine shown in FIGS. 3 and 4 is particularly well adapted to the implementation of the drainage method of the invention. It is of the type described in the patent application 2 546 203 in the name of the present Applicant, already mentioned. It comprises a chassis 11 supporting a tank 12 which contains filtering material 7 intended to flow through a spout 13 into a trench formed progressively as an excavating member 14 raises the earth. The direction of advance of the machine is shown schematically by an arrow f which therefore also defines the front and rear of the machine.

Tank 12 is such that the material flows by gravity through spout 13. A horizontal flap 15 can close it or regulate the flow therefrom, whereas a vertical flap 16 serves for adJusting the height of its opening as a function of the depth of the trench. The excavating member 14 rotates in the opposite direction to the wheels 17 of the machine. It is formed of a wheel on the periphery of which is fixed a plurality of knives or fingers. As shown in FIG. 3, the excavating wheel 14 discharges the earth towards the front and projects it vertically towards a deflecting member 18. This latter sends the earth downwards but to the side. At the rear of wheel 14 and in front of spout 13 a ploughshare 19 smooths the earth at the bottom of the trench.

The machine is provided with an endless belt 20 for recovering the earth. Belt 20 is oriented longitudinally in accordance with a slope rising from the front to the rear. Preferably, its length is such that it extends appreciably beyond the rear of the machine, so as to facilitate the use of any kind of subsidiary means for removing the earth from the site where the machine is working. In another embodiment, the belt may be oriented forwards, so as to pass at the side of the power unit and be in line with a skip or tub provided at the front thereof.

Belt 20 may be driven by a take-off from the power unit, generally a tractor, as well as that of the excavating wheel 14. In another embodiment, belt 20 is driven from the hydraulic system of the power unit, in which case it operates independently of the excavating wheel 14.

The wheels 17 of the machine shown in FIG. 3 are four in number and they each comprise a height adjustment device. In another embodiment, the machine only comprises rear wheels and the front is supported by the power unit. In this case, between each wheel and chassis 11 a double acting jack is provided for adjusting the earth removal and the raising of the excavating wheel. This machine has the advantage of being able to be manoeuvred by a relatively small power unit, compared with the four wheeled machine which must be lifted for each change of direction. According to the invention, belt 20 is removable or else movable from its position of use, so as to allow a trench to be formed without recovery of the earth. This earth is then thrown to the side of the trench by deflector 18, in the form of a ridge A. The purpose of a levelling blade 21, adjustable in height by means of a jack, is to eliminate ridge A.

According to another characteristic of the invention, the machine comprises means for laying a drain 22 at the bottom of a trench progressively as the latter is formed by the excavating wheel 14. These means comprise a drain drum 23, preferably carried by the upper front part of the machine.

From the drum 23 the drain 22 is guided under the front wall of tank 12 and into a well Z4 between spout 13 and ploughshare 19, whence it leaves rearwards while passing under spout 13. For this, the base of the latter is offset upwards with respect to the base of the ploughshare 19 by a height slightly greater than the diameter of drain 22.

In practice, spout 13, ploughshare 19 and well 24 form an assembly defined by two laterals walls 25 and 26, FIG. 4, and substantially of the same width as the dug trench. Said assembly cooperates with the levelling blade 21 to prevent the earth discharged inwardly by the latter from falling back into the trench.

For ground renovation, the recovery function of the earth using the belt 20 will of course be used. It will also be used, preferably, for constructing trenches receiving drains if, because their depth is greater than that of the topsoil, the earth removed contains a high proportion of inorganic material. On the other hand, for the other trenches, levelling of the earth on the site further facilitates implementation of the method of the invention.

I claim:

1. A drainage method for use in the construction or renovation of stabilized grounds, grass-covered grounds and sports grounds comprising the steps of:

levelling and improving a topsoil;

placing said topsoil onto a levelled platform;

forming a network of first surface drainage trenches and second surface drainage trenches of the same width over the whole surface of the ground, wherein said second surface drainage trenches orthogonally cross said first surface drainage trenches;

orienting said second trenches in a direction of slope of said ground;

making said second trenches deeper than said first trenches, wherein the depth of said second trenches substantially correspond to the depth of a base of the layer of said topsoil;

providing said second trenches at their bottom with drains, wherein said drains are positioned below the level of the bottom of said first trenches and communicate with a collector positioned at a side portion of the ground; and filling the trenches with filtering material.

2. Method according to claim 1, comprising the further step of:

substantially forming said second trenches with recovery of extracted earth.

3. Method according to claim 1, comprising the further step of:

substantially forming said first trenches while throwing out and levelling extracted earth at a side of said trench.

4. Method according to one of claims 1, 2 or 3, comprising the further step of:

covering the whole ground with a layer of sand based drainage material.

5. Method according to claim 4, comprising the further step of:

forming said drainage material by homogeneously mixing said with synthetic or plant fibers.

6. Method according to claim 5, wherein said surface layer has a thickness of about between 2 and 8 cm.

7. Method according to claim 1, wherein said first and second trenches each have a width of about 7 cm.

8. A machine for forming a drainage system comprising:

a chassis, an excavating wheel, and an endless belt. said excavating wheel being mounted on said chassis, said endless belt being used for recovering earth extracted by said excavating wheel, wherein a trench is formed as said excavating wheel extracts the earth;

a tank containing a filtering material, said tank having means for pouring said filtering material into said trench as said trench is formed, the rotation of said wheel being such as to raise the earth towards the front of the machine; and means for laying a drain at the bottom of said trench as the trench is progressively formed by said excavating wheel, and before said trenches are filled with said filtering material.

9. A machine according to claim 8, wherein said means for laying said drain comprises a drum mounted on the front of the machine, guiding means for guiding the drain under said tank, and a well from which the drain leaves rearwards into the trench, said well being positioned in front of the means for pouring the filtering material, said well comprising a rear wall having a base, the base of said rear wall of the well being offset upwards with respect to the bottom of the trench by a height slightly greater than that of the drain, wherein said drain is applied at the bottom of the trench.

10. Machine according to claim 8 or 9, wherein said endless belt is removable or movable from its position of use, so that the earth may be thrown, by means of a deflecting member to the side of the dug trench.

11. Machine according to claim 10, comprising a levelling blade for eliminating a ridge formed at the side of the trench when the belt is not used.

12. A drainage system for use in construction or renovation of stabilized grounds, grass-covered grounds and sports grounds, wherein said grounds comprise:

a layer of improved and levelled topsoil having a base and placed onto a levelled platform, said drainage system comprising a network of first surface drainage trenches and second surface drainage trenches of the same width orthogonally crossing the first trenches, said first and second trenches being formed over the whole surface of the ground, said second trenches being oriented in a direction of slope of the ground and being deeper than said first trenches, the depth of said second trenches substantially corresponding to the depth of the base of the layer of topsoil, the second trenches being provide at their bottom with drains, said drains being position below the level of the bottom of said first trenches and being in communication with a collector which is positioned at a side portion of said ground, said assembly of trenches being filled with filtering material.

13. Drainage system according to claim 12, wherein said trenches are formed after the topsoil has been improved and levelled.

14. Drainage system according to claim 13, wherein said second trenches are formed with recovery of extracted earth.

15. Drainage system according to claim 13, wherein said first trenches are formed while throwing out and levelling extracted earth at the side of the trench.

16. Drainage system according to claim 15, wherein the whole ground is covered with a layer of sand based drainage material.

17. Drainage system according to claim 16, wherein said drainage material comprises a mixture of sand and intermingled synthetic or plant fibers.

18. Drainage system according to claim 17, wherein said surface layer has a thickness of between about 2 and 8 cm.

19. Drainage system according to claim 12, wherein said first and second trenches each have a width of about 7 cm.

* * * * *